United States Patent [19]

Cucinotta et al.

[11] 4,247,756

[45] Jan. 27, 1981

[54] HEATED FLOOR MAT

[76] Inventors: Victor Cucinotta, 11 George St., Stoneham, Mass. 02180; George Florea, 402 Stephen Rd., San Mateo, Calif. 94403

[21] Appl. No.: 53,708

[22] Filed: Jun. 29, 1979

[51] Int. Cl.[3] ..... H05B 3/34

[52] U.S. Cl. ..... 219/528; 219/217; 219/543; 219/544; 219/549; 338/212

[58] Field of Search ..... 219/211, 212, 213, 217, 219/527, 528, 543, 544, 549, 553, 509, 510, 512; 338/210, 211, 212; 165/56; 237/43

[56] References Cited

U.S. PATENT DOCUMENTS

| | | | |
|---|---|---|---|
| 2,404,736 | 7/1946 | Marick | 219/528 X |
| 2,458,184 | 1/1949 | Marick | 219/543 X |
| 2,473,183 | 6/1949 | Watson | 219/543 |
| 2,559,077 | 7/1951 | Johnson et al. | 219/543 |
| 2,624,823 | 1/1953 | Lytle | 219/543 X |
| 3,344,385 | 9/1967 | Bartos | 219/528 X |
| 3,878,362 | 4/1975 | Stinger | 219/528 |
| 4,031,356 | 6/1977 | Niibe | 219/509 |
| 4,055,526 | 10/1977 | Kiyokawa et al. | 264/22 |
| 4,074,222 | 2/1978 | Kiyokawa et al. | 338/212 |
| 4,139,763 | 2/1979 | McMullan et al. | 219/528 |

*Primary Examiner*—Volodymyr Y. Mayewsky
*Attorney, Agent, or Firm*—Thompson, Birch, Gauthier & Samuels

[57] ABSTRACT

A heated rubber mat comprising upper and lower rubber panels and an intervening carbon-loaded electrically resistive rubber heating element. All are vulcanized together to form a unitary mat structure characterized by good flexibility permitting rolling up the mat in any direction and by permanent shape retention, said heating element having spaced, flexible electrodes fully enclosed therein and bonded thereto, along with associated, thermostatically controlled current receiving means, whereby current may be transmitted through the portions of the heating element lying between said electrodes to generate heat and whereby the mat may be maintained at the desired temperature.

2 Claims, 4 Drawing Figures

HEATED FLOOR MAT

BACKGROUND OF THE INVENTION

The present invention relates to an electrically heated floor mat adapted to heat the feet and lower body portions of a person standing on the mat or seated in a chair resting thereon. In the latter case, the mat is normally provided with a heated apron portion extending from one side thereof on which the occupant of the chair usually rests his feet. Planar heating elements, and more particularly heated floor mats, have been proposed. Typically, prior art floor mats are heavy and stiff and therefor awkward to handle. Mats have been proposed which are flexible, but these typically are gouged by chair legs, sharp heels, etc.

The prior art suggests many forms of planar heating elements or floor mats. The following U.S. Pat. Nos. disclose heating units of various types.

2,277,772, 2,299,162 and 2,404,736 to L. Marick, and 3,400,254 to Takemori disclose fabric heating devices which incorporate a heat-generating layer.

2,473,183 to Watson discloses the use of carbon black in combination with a copolymer, such as vinyl chloride and vinyl acetate.

2,540,295, Schreiber discloses a rigid panel heater adapted for use in the wall or ceiling.

2,612,585 discloses the use of rubber or synthetic rubber in a floor mat.

3,344,385, Bartos discloses the use of natural or synthetic rubber containing electrically-conductive particles suspended in a flexible or stretchable carrier.

3,513,297, Jordan discloses heat-radiating rugs or the like containing enclosed filaments of an electrical resistance material.

3,547,725 discloses heat-expandable plastic, such as a polyvinyl chloride-acetate copolymer.

3,553,834, Olstowski et al. discloses a carpet having a conventional backing layer beneath which lies an electrically conductive graphite layer and a second conventional backing layer.

3,657,516, Fujihara discloses a panel type of heater which, though flexible, is not resilient and is not capable of bearing the high loads typically encountered by chair-supporting floor mats.

3,749,886, Michaelsen discloses an electrically heated floor mat having a carbon-loaded sheet. The sheet and its cover may be fabricated of rubber and vulcanized together.

3,790,753, Miller discloses the use of a styrene butadiene rubber in combination with a heating wire network.

3,858,144, Bedard et al. discloses incorporating carbon black in various polymers.

3,859,504 discloses the use of a polyethylene in combination with heating elements.

3,878,362 and 3,900,654, Stinger disclose various chemical compositions for heated structures.

2,458,184, 2,544,547, 2,559,077, 2,782,289, 3,281,579, 3,359,524 and 3,621,192 are also of interest.

SUMMARY OF THE INVENTION

The present invention is directed to a heated floor mat comprised of outer non-conductive rubber layers and an inner carbon loaded electrically resistive layer, all formed together in a laminated heating mat of unitary construction. The heating mat in a preferred embodiment has electrodes therein whereby current may be transmitted through portions of the heating elements lying between the electrodes to generate heat.

The invention is directed to a heated floor mat comprising outer rubber-like layers sandwiched about an inner electrically resistive layer and electrically conductive elements in communication with the resistive layer. At least one outer layer and the inner layer are each formulated, when laminated to provide the desired characteristics of heat transfer, toughness and resiliency.

The inner layer is primarily formulated for its electrical resistive characteristics. These characteristics are determined in connection with the layer to which the inner layer is laminated.

The outer layer is formulated primarily in regard to resiliency and toughness but also in connection with the heat generated by the resistive inner layer. Thus, in addition to being formulated for resiliency and toughness, it must also possess the necessary thermoconductivity or heat transfer characteristics based on the heat generated by the inner layer.

Accordingly, both inner and outer layers are each formulated for primarily different purposes but each formulation is dependent on the characteristics of the layer to which it is laminated.

The formulation of the outer layer comprises a synthetic rubber; inert fillers in a ratio of rubber to filler of from 1:2 to 1:4 parts by weight; and a thermosetting resin in a ratio of resin to rubber of from 0.3:1.0 to 0.5:1.0 parts by weight and suitable additives such as accelerators, release agents, etc.

The formulation of the inner layer comprises a synthetic electrically resistive rubber; electrically conductive carbon black in ratio of carbon black to rubber of from 0.7:1 to 1.3:1 parts by weight, a plastisizer in a ratio of plastisizer to synthetic rubber of from 0.7:1 to 1.3:1 parts by weight, together with suitable additives as necessary.

DESCRIPTION OF THE PREFERRED EMBODIMENT

Figure 2:
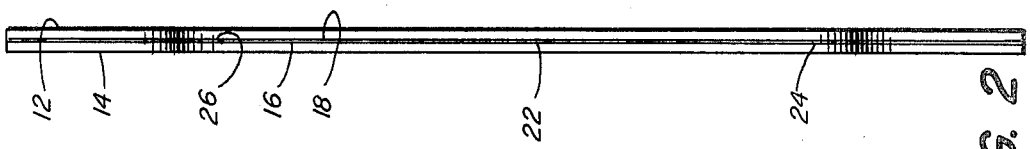
FIG. 2 is an end view, generally schematic in nature, of the end of the mat carrying an extended apron portion acting as a foot rest, said figure showing two outer rubber layers, two enclosed resistive rubber layers and three electrodes set in place between the resistive layers.
Figure 1:
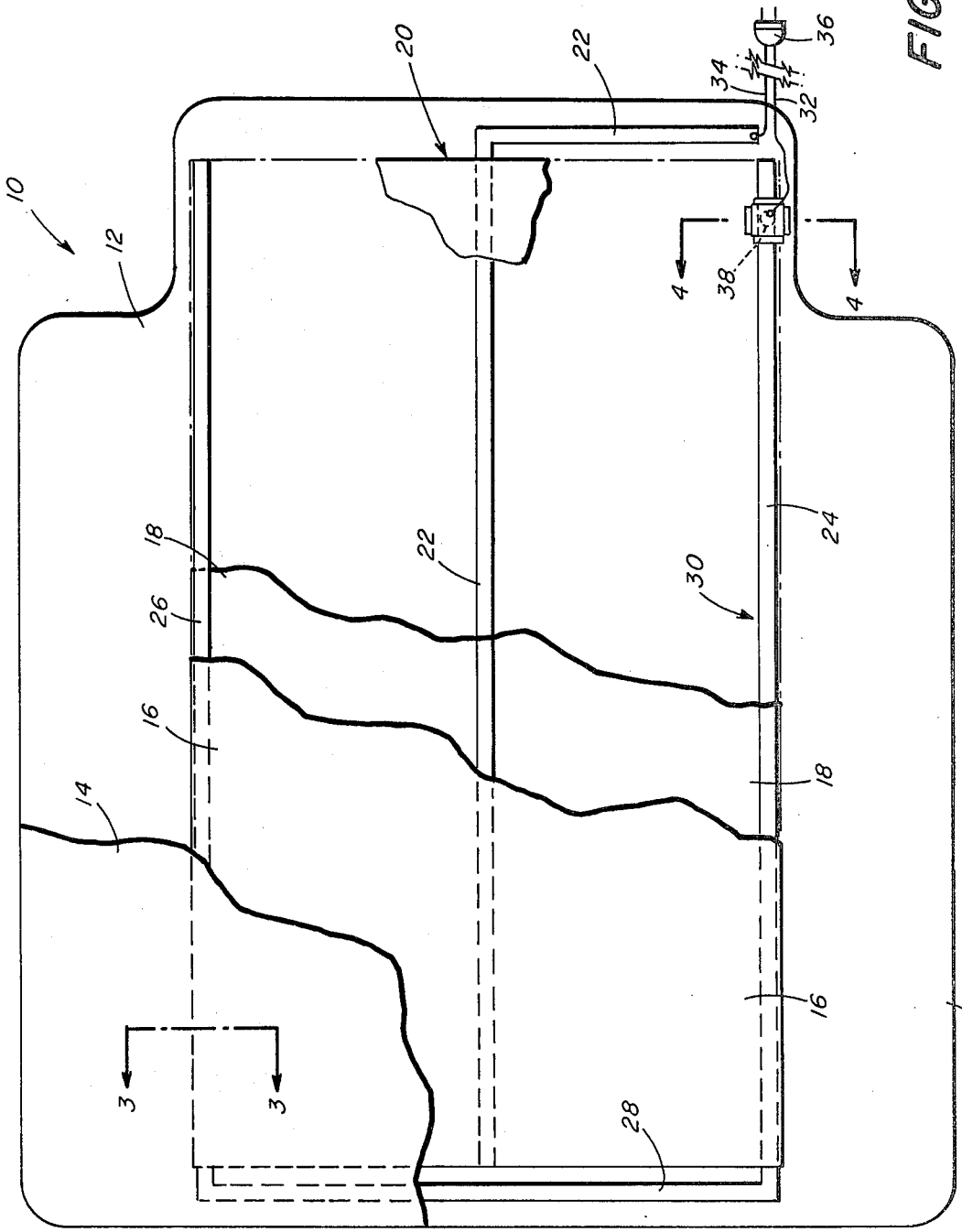
FIG. 1 is a plan view of a heated floor mat of this invention, with parts being broken away for clarity, and showing each member of the mat assembly.

Referring more particularly to FIGS. 1 and 2, there is shown a heated floor mat 10 embodying the invention having a relatively thin outer (bottom) layer 12 and a somewhat thicker outer (top) layer 14 having the same shape, in outline, as layer 12. These layers, which are essentially nonconductive to electrical current, are vulcanized to one another about the entire peripheral area of the mat as well as in those areas where they are in direct contact with one another. In the remaining areas they are vulcanized to rectangular electrically inner layers 16 and 18 positioned one above the other and vulcanized together. These inner layers 16 and 18 cover a broad central area of the mat 10 and extend into a foot-rest apron area 20 shown as extending from one margin of the mat 10.

Mounted between the inner layers 16 and 18 is a centrally disposed electrode 22 as well as outer electrodes 24 and 26 which run parallel to the central electrode 20 and are of a length equal thereto. They extend longitudinally adjacent the edges of the inner layers 16 and 18. The electrodes 24 and 26, joined to a conductor 28, from a generally U-shaped member 30 which connects with an incoming lead wire 32. The conductor 28 does not serve as an electrode since it runs between rubber layers 12 and 14 and out of contact with the resistance layers 16 and 18. The centrally disposed electrode 22 is connected to another incoming lead wire 34, both lead wires 32 and 34 extending from a conventional electrical fitting indicated at 36 which may be of either the male or female type. Electrodes 22 and 24 constitute one electrode pair and serve to generate heat in the resistance layer portions lying therebetween, and electrodes 22 and 26 constitute a second electrode pair and generate heat in the resistance layers laying therebetween.

Figure 3:
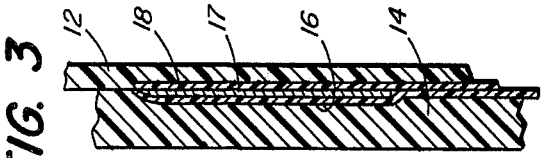
FIG. 3 is a sectional view, to an enlarged scale, taken along the line 3—3 of FIG. 1 and showing an outer electrode set between the resistive rubber layers.
Figure 4:
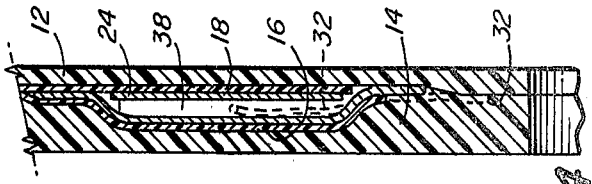
FIG. 4 is a sectional view, also to an enlarged scale, taken along the line 4—4 of FIG. 1 and showing the other outer electrode set between the resistive rubber layers as well as a thermostat device set between said layers.

A thermostat 38, shown in greater detail in FIG. 4, is mounted in any convenient place on the mat, it here being shown as positioned between the resistance layers 14 and 16 at a convenient position near the margin of the apron extension as shown in the drawings.

In one specific embodiment, the rubber mat shown in the drawings is formed by first laying down in a rubber vulcanizing press the bottom rubber outer layer 12 formulated of a vulcanizable rubber material and having a thickness of about 0.07 inch. On top of this layer 12 is placed a first carbon-loaded, resistive inner layer 14 having a thickness of about 0.026 inch, care being taken to so position this sheet as to leave an uncovered margin of the layer 12 about the edges. Following this the electrodes 22, 24 and 26 are such as copper strips coated on both sides with an electrically conductive rubber cement, as well as the conductor 28 and the connecting wire lead assembly including thermostat 38 are all layed in. Next layed in is the second carbon-loaded, resistive sheet 16 having a thickness of about 0.026 inch. Finally, the top rubber outer layer 14 formulated of a vulcanizable rubber material is layed into place. The whole assembly is then vulcanized into a unitary, laminated product using a temperature cycle of 15 minutes at 375° F.

It will be seen that the portions of strips 22, 24 and 26 which act as electrodes are full enclosed by the resistive layers 16 and 18. This construction makes it extremely unlikely that the flow of current between the electrodes through layers 16 and 18 will in any way be impeded even if the adhesive bond between the electrodes and the adjacent surfaces of said layers is broken. This situation could be otherwise where the electrodes to be bonded on one side to a resistive layer and on the other side to one or the other of the outer layers 12 and 14.

As stated above, the outer layers 12 and 14 of the mat are fabricated from a formulation which is capable of being vulcanized to form a strong, flexible and durable layer and which layer consistent with the heat generated by the inner layers has the proper heat transfer characteristics.

The following exemplifies a formulation use for the outer layers.

| | Parts By Weight |
|---|---|
| Styrene butadiene rubber | 100 |
| A plasticizer and softening agent such as a mixture of high molecular weight oil-soluable sulfonic acid with a paraffin oil | 5 |
| A stearic acid lubricant | 1 |
| Zinc oxide | 5 |
| An alkyl-substituted diphelyl amine antioxidant | 1 |
| Ceresin wax as a processing aid | 1 |
| Coumarone-indene modifier | 40 |
| Hard clay | 175 |
| Calcium carbonate | 100 |
| Titanium dioxide | 20 |
| Sulfur vulcanizing agent | 4.5 |
| Benzothiazyl disulfide accelerator | 3 |
| Tetramethyliuram disulfide accelerator | 1 |

The principal components of the formulation may be varied (parts by weight) as follows: one part rubber to 2 to 4 parts filter to 0.3 to 0.5 parts by weight thermosetting resin. The other components, each may be varied ± 15% parts by weight based on 100 part by weight rubber.

The formulation for the resistive inner layers 16 and 18 employs a heat resistant rubber such as a polyepichlorodrin or a copolymer of epichlorohydrin and ethylene oxide mixed with an effective amount of conductive carbon black and such other additives as vulcanizing agents, stabilizers-activators, lubricants and plasticizers as required. The formula set forth below provides a resistive rubber which, when incorporated in the finally vulcanized mat and connected to the conventional power outlet, readily heats to 115° F. in 30 seconds and achieves an overall mat temperature of 115° F. in 4 minutes in the case of a mat having the dimensions described above. This mat has a 15 ohm/cm volume resistivity and thus, when connected to a standard 110 volt line, draws a current of 8 amperes consuming 105.6 watts in heat energy.

| | | Parts by Weight |
|---|---|---|
| 1. | Epichlorohydrin-ethylene oxide copolymer rubber (hydrin 200-70, a product of B. F. Goodrich Co., Cleveland, Ohio) | 100 |
| 2. | Zinc stearate, as an activator-lubricant | 1.5 |
| 3. | Red Lead | 5 |
| 4. | Nickel dimethyldithiocarbamate | 1 |
| 5. | Carbon black (N-472 of J. N. Huber Corporation of Rumson, J.J. 07760) | 90 |
| 6. | Tributoxyethyl phosphate as a plasticizer | 25 |
| 7. | Lubricant/release agent (ZO-9 of Yerzley and Company, Newark, N.J.) | 0.5 |
| 8. | Vulcanizing agent made up of a dispersion of 75% 2-mercaptoimidazoline in epichlorohydrin | 0.8 |

Other heat resistant rubbers such as butyl rubber, neoprene rubber and silicone rubber can be substituted for that employed in the above to have the desired electrical properties by making adjustments with the concentration and type of carbon black and the auxiliary agents employed. The conductive carbon black employed may be any of the commercial superconductive carbons such as the above-illustrated N-472 from J. M. Huber Corporation, along with Vulcan XC-72 from Cabot Corporation.

The principal components of the formulation may be varied as follows: (parts by weight) one part rubber to 0.7 to 1.3 parts carbon black; one part rubber to 0.7 to 1.3 parts plastizer. The other components, each may be varied ± 15% parts per weight based on 100 parts by weight of rubber.

The layers 12 and 14, and 16 and 18 can be formed from the proper formulations using conventional Banbury mixing followed by rubber mill sheeting of stock or by rubber mill mixing and sheeting operations.

What we claim is:

1. An integral electrically heated floor mat comprised of outer conductive and electrically non-conductive layers and an inner-electrically resistive layer, said inner layer having parallel spaced flexible electrodes enclosed therein and conductively bonded thereto, the outer layers each consisting essentially of styrene butadiene rubber and inert materials in an amount of 1 part rubber to 2 to 4 parts by weight inert material, and a thermosetting resin, 1 part rubber to 0.3 to 0.5 parts by weight thermosetting resin; the inner layer consisting essentially of a rubber selected from the group consisting of epichlorohydrin-ethylene oxide copolymer rubber, butyl rubber, neoprene rubber and silicone rubber and combinations thereof, a plasticizer and carbon black, 1 part rubber to 0.7 to 1.3 parts by weight carbon black, 1 part rubber to 0.7 to 1.3 parts by weight plasticizer;

the inner and outer layers being sealed to each other and the inner layer being sealed inside the outer layer; and a thermostatically controlled current receiving means in electrical communication with the electrodes, said means having a switch in a normally closed position to conduct electrical current to the electrodes, the switch adapted to move to an open position when a predetermined temperature is reached whereby current may be transmitted through portions of the inner electrically resistive layer lying between the said electrodes to generate heat.

2. The heated floor mat of claim 1 wherein the inert materials are selected from the group consisting of clay, calcium carbonate, titanium dioxide and combinations thereof.

* * * * *